US006474703B1

(12) United States Patent
Berg

(10) Patent No.: US 6,474,703 B1
(45) Date of Patent: Nov. 5, 2002

(54) TRUNK-BOOT LATCH

(75) Inventor: Gert Berg, Cheltenham (GB)

(73) Assignee: Southco Inc., Concordville, PA (US)

( * ) Notice: Subject to any disclaimer, the term of this patent is extended or adjusted under 35 U.S.C. 154(b) by 35 days.

(21) Appl. No.: 09/679,346

(22) Filed: Oct. 4, 2000

(51) Int. Cl.[7] ..... E05C 3/06

(52) U.S. Cl. ..... 292/200; 292/DIG. 61; 292/336.3; 292/203

(58) Field of Search ..... 292/200, 202, 292/203, DIG. 61

(56) References Cited

U.S. PATENT DOCUMENTS

| | | | | | |
|---|---|---|---|---|---|
| 3,782,141 | A | * | 1/1974 | Doerrfeld | 70/146 |
| 4,683,736 | A | * | 8/1987 | Weinerman et al. | 70/208 |
| 4,969,916 | A | * | 11/1990 | Weinerman et al. | 70/208 |
| 5,201,557 | A | * | 4/1993 | Schlack | 292/161 |
| 5,413,391 | A | * | 5/1995 | Clavin et al. | 292/170 |
| 5,974,842 | A | * | 11/1999 | Schlack et al. | 70/208 |
| 6,109,669 | A | * | 8/2000 | Pinkow | 292/175 |

OTHER PUBLICATIONS

Southco Handbook 2000, pp. 108–109; 115–117, 1999 Southco Inc.

* cited by examiner

*Primary Examiner*—Robert J. Sandy
*Assistant Examiner*—André L. Jackson
(74) *Attorney, Agent, or Firm*—Paul & Paul

(57) ABSTRACT

The present invention is a latch for securing a first closure member, such as a lid or cover of an automotive vehicle, in place relative to a second closure member, such as a floor or wall of an automotive vehicle. The latch includes a housing and a handle. The housing includes a channel. The handle includes a handle member, a pawl, a pair of pawl-related biasing members, and a channel-related biasing member. The latch can be opened and closed by grasping and rotating the handle member. The first closure member that is in contact with the latch may be raised by grasping and rotating the handle member upward, and then raising the first closure member upward by way of the handle member. The first closure member may be lowered by grasping and rotating the handle member upward, and then lowering the first closure member downward by way of the handle. Alternatively, the first closure member may be lowered by releasing the handle member when the first closure member is in the raised position.

7 Claims, 6 Drawing Sheets

TRUNK-BOOT LATCH

BACKGROUND OF THE INVENTION

1. Field of the Invention

The present invention relates to latches for mounting flush in panels and in particular to flush-mounted latches for automotive applications.

2. Brief Description of the Prior Art

Flush-mounted latches are known in the art. For example, the *Southco Handbook* 2000 (Southco, Inc., Concordville, Pa.) discloses flush mounted push-to-close latches (p. 111) in which the latching pawl is spring-biased forward, and shaped so that pushing the door or panel in which the latch is mounted shut will cam the latching pawl backwards against the bias, permitting the latch to open and then lock after the door is completely closed. This "slam-action" permits the door to be closed without direct, purposeful operation of the latch.

Although there are many applications for which slam-action type flush mounted latches are appropriate solutions, there are other application for which such slam-action latches are not desirable. For example, in automotive and other applications, when a door or panel is designed to open upward by rotation on a generally horizontal axis, accidental latching of the panel may occur if the panel or door is released inadvertently. One example of such an application is latches for panels in load floors in auto trunks or "boots" used for storage. Flush-mounted latches are desirable for such applications for design and esthetic reasons, and it may be desirable to avoid accidental latching of these enclosures.

Another type of flush-mounted latch is the Lift and Turn® rotary compression latch, shown in the Southco Handbook 2000, at page 41. In this latch, the flush-mounted handle is lifted and rotated to rotate a pawl. Direct, purposeful action is required to close and latch a door fitted with this type of flush-mounted latch. Such flush-mounted latches requiring direct operation of the latch to close the latch tend to be more complicated mechanically, and thus more expensive, than many push-to-close latches.

U.S. Pat. No. 5,409,272, issued to Edward A. McCormack on Apr. 25, 1995, describes an over-center latch assembly. The front of the handle must be pushed downward to raise the rear grasping portion of the handle, thereby bringing the handle into engagement with a cam surface. Continued rotation of the handle actuates the latch.

The Southco Handbook 2000, page 121, illustrates a flush-mounted push-to-close latch wherein the handle is first pushed inward to raise the grasping portion of the handle outward.

There is a continuing need for a simple flush-mounted latch that can easily be operated to open the latch and yet can be pushed to close and latch the panel or door in which the latch is mounted.

SUMMARY OF THE INVENTION

The present invention provides a simple flush-mounted trunk-boot latch that can be operated to open the latch. The trunk-boot latch of the present invention does not require direct operation of the latch to secure the panel or door in which the trunk-boot latch is mounted; the trunk-boot latch can be operated by pushing the door or panel in which the trunk-boot latch is mounted to close the door or panel.

The trunk-boot latch of the present invention is simple to manufacture, assemble and install, and is preferably assembled from only two parts, a housing and a handle/pawl unit.

The trunk-boot latch of the present invention includes a housing, a handle, a pawl, and a plurality of flexible, spring or biasing elements.

The housing includes a partial front wall, a rearwall, a pair of partial side walls, a partial bottom wall, a substantially open top, a substantially vertical channel, a substantially hollow interior, a pair of lugs, a pair of guides, a pair of stops, a resilient snap leg, and a vertical extension.

The front wall, side walls, and bottom wall of the housing define a cutout that is dimensioned and configured to receive at least a pawl when the housing and handle unit are secured to one another. Each side of the housing includes means for pivotally securing a handle, preferably an aperture. The bottom of the housing includes an upwardly extending flange along its front edge. The top of the housing includes an outwardly extending flange around its outer edge.

The channel is positioned against and forward of the upwardly extending flange, and is dimensioned and configured to receive a flexible, channel-related spring. The channel is also dimensioned and configured to retain the channel-related spring when the handle is secured and actuating or pivoting relative to the housing. The lower portion of the channel is a predetermined amount wider from front to rear than the upper portion of the channel.

The lugs, at the front of the housing, help the latch to engage with the lid. The guides in the front of the housing restrain horizontal movement of the pawl during slam action closure of the latch. The snap leg, at the rear of the housing, has a hook-like structure for also helping the latch to engage with the lid. The stops prevent the rear of the handle from being pushed past a predetermined point when the rear of the handle is pushed downward toward the housing. At the rear of the housing, the vertical extension also helps the latch to engage with the lid.

The handle unit includes a flush-fitting handle, a pawl, a pair of flexible, pawl-related springs, and the flexible, channel-related spring. The handle has a front wall, a rear wall, a pair of side walls, a top wall, and a substantially open bottom. The rear wall of the handle permits the handle to be lifted and rotated for opening and closing the latch. Each side wall of the handle includes means for pivotally securing a handle, preferably a pin that is dimensioned and configured to fit within the corresponding aperture.

The pawl is positioned forward of and below the front of the handle. The pawl includes a front, a rear, a pair of sides, a top, and a bottom edge. The pawl is attached to the pawl-related springs, which are attached to the pawl member. The vertical extension of each pawl-related spring helps prevent the pawl and pawl-related springs from flexing or bending upward past a predetermined point above their resting positions.

The channel-related spring has a first end, a stem, and a generally "U"-shaped second end, and is substantially vertical in its relaxed position. The generally "U"-shaped second end is a predetermined amount wider from front to rear and from side to side than the stem, and is positioned within the lower portion of the channel when the handle unit is secured to the housing. The shape and configuration of the generally "U"-shaped second end help to retain the generally "U"-shaped second end within the lower portion of the channel when the handle unit is actuated or rotated relative to the housing.

It is therefore an object of the present invention to provide a latch that may be placed in a closed position by slamming it shut.

It is another object of the present invention to provide a latch having a flush-fitting handle, thereby preventing interference with anyone or the placement of other things adjacent the latch.

It is a further object of the present invention to provide a latch that may be easily assessed by a user.

These and other objects of the invention will become apparent through the following description and claims.

BRIEF DESCRIPTION OF THE DRAWINGS

Like reference numbers denote like elements throughout the drawings.

DETAILED DESCRIPTION

The present invention provides a simple, flush-mounted trunk-boot latch for securing a first closure member, such as automotive trunk-boot lid or door in place relative to a second closure member, such as an automotive body or panel. The trunk boot latch of the present invention is easy to install, can be easily operated by using one or two fingers, and advantageously provides the trunk-boot panel or lid to be slammed closed.

Figure 1:
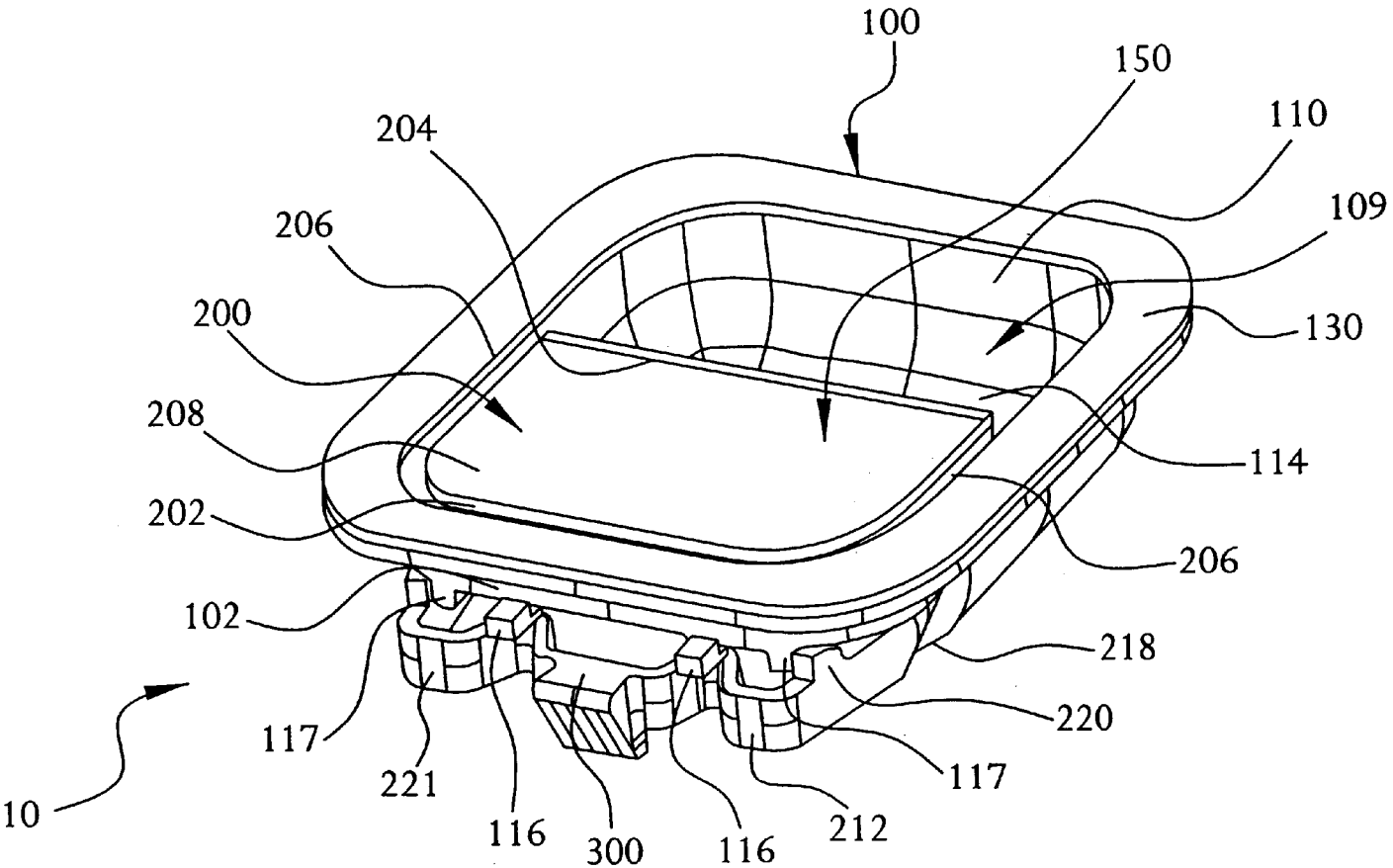
FIG. 1 is a top perspective view of a latch according to the present invention.

Referring now to the figures in which like reference numerals refer to like elements in each of the several views, there is shown in FIG. 1 a trunk-boot latch 10 according to the present invention.

Figure 2:
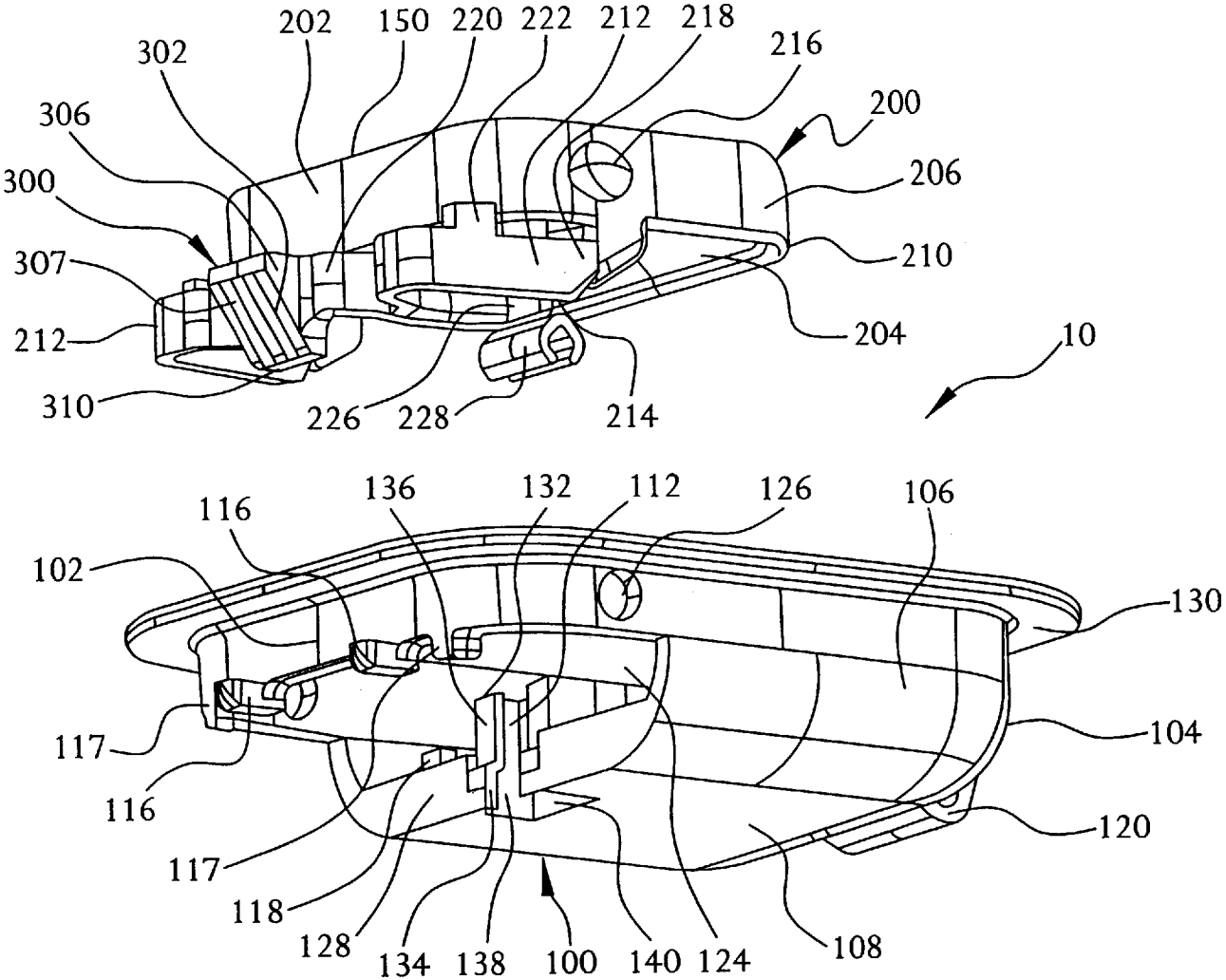
FIG. 2 is an exploded view of the latch of FIG. 1.
Figure 3:
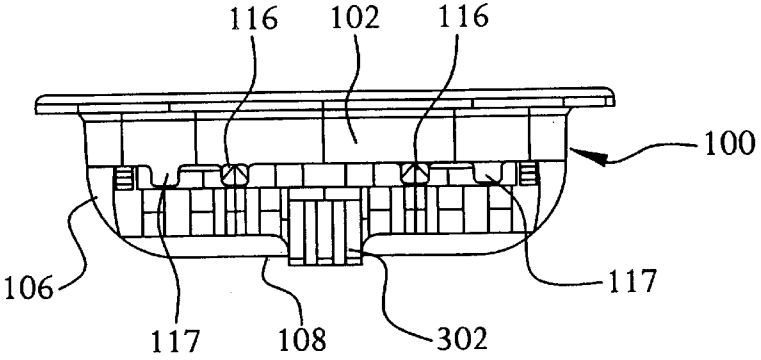
FIG. 3 is a front view of the latch of FIG. 1.
Figure 7:
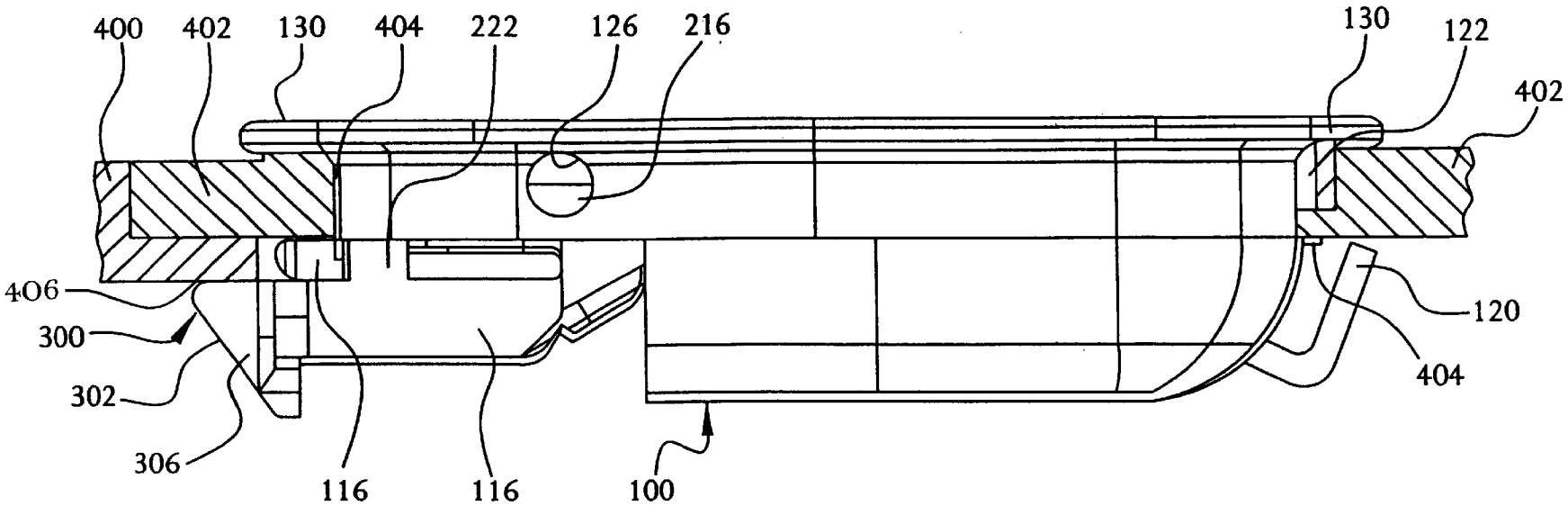
FIG. 7 is an environmental left side view of the latch of FIG. 1.

As best seen in the exploded perspective view of FIG. 2, the trunk-boot latch 10 preferably comprises only two parts, a housing 100 and a handle unit 150 rotationally mounted inside the housing 100, as best seen in FIG. 7. As best seen in FIG. 2, the handle unit 150 comprises flush-fitting handle 200, and a pawl 300.

Figure 6:
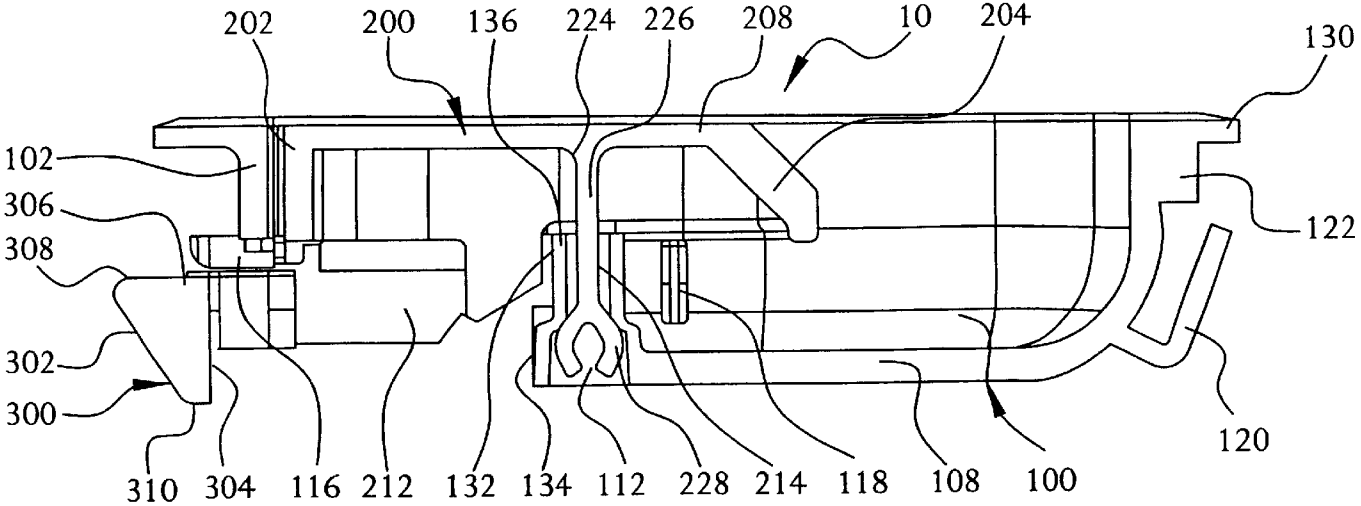
FIG. 6 is a cross sectional left side view of the latch of FIG. 1.
Figure 6A:
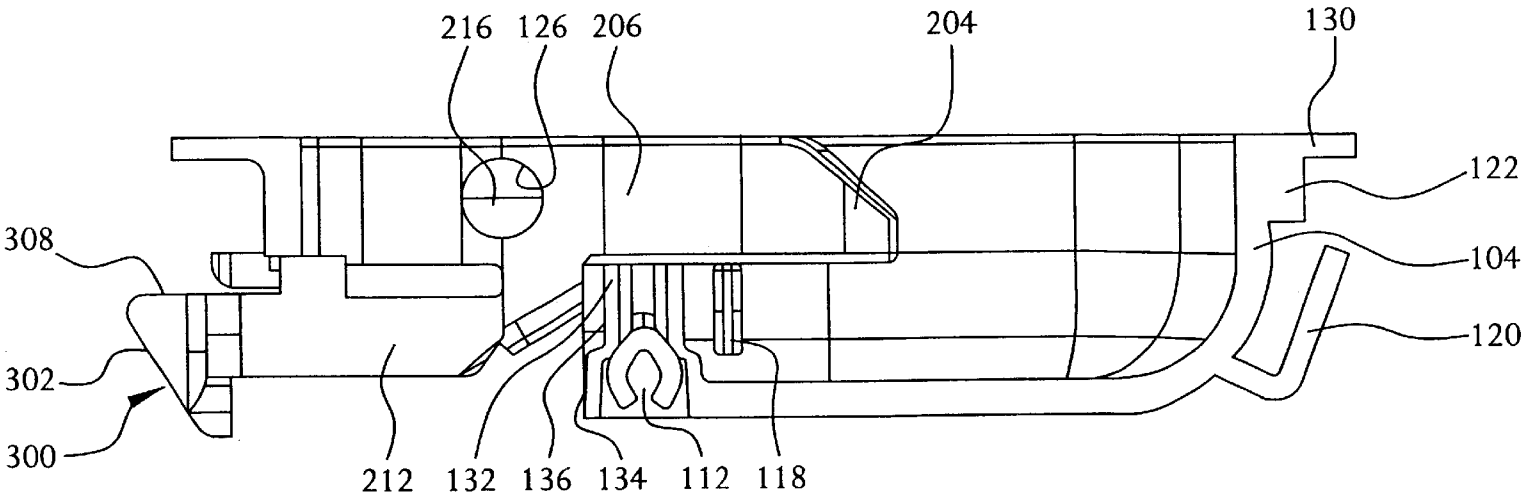
FIG. 6A is a cross sectional left side view of the of the latch illustrating the housing in cross section.
Figure 8:
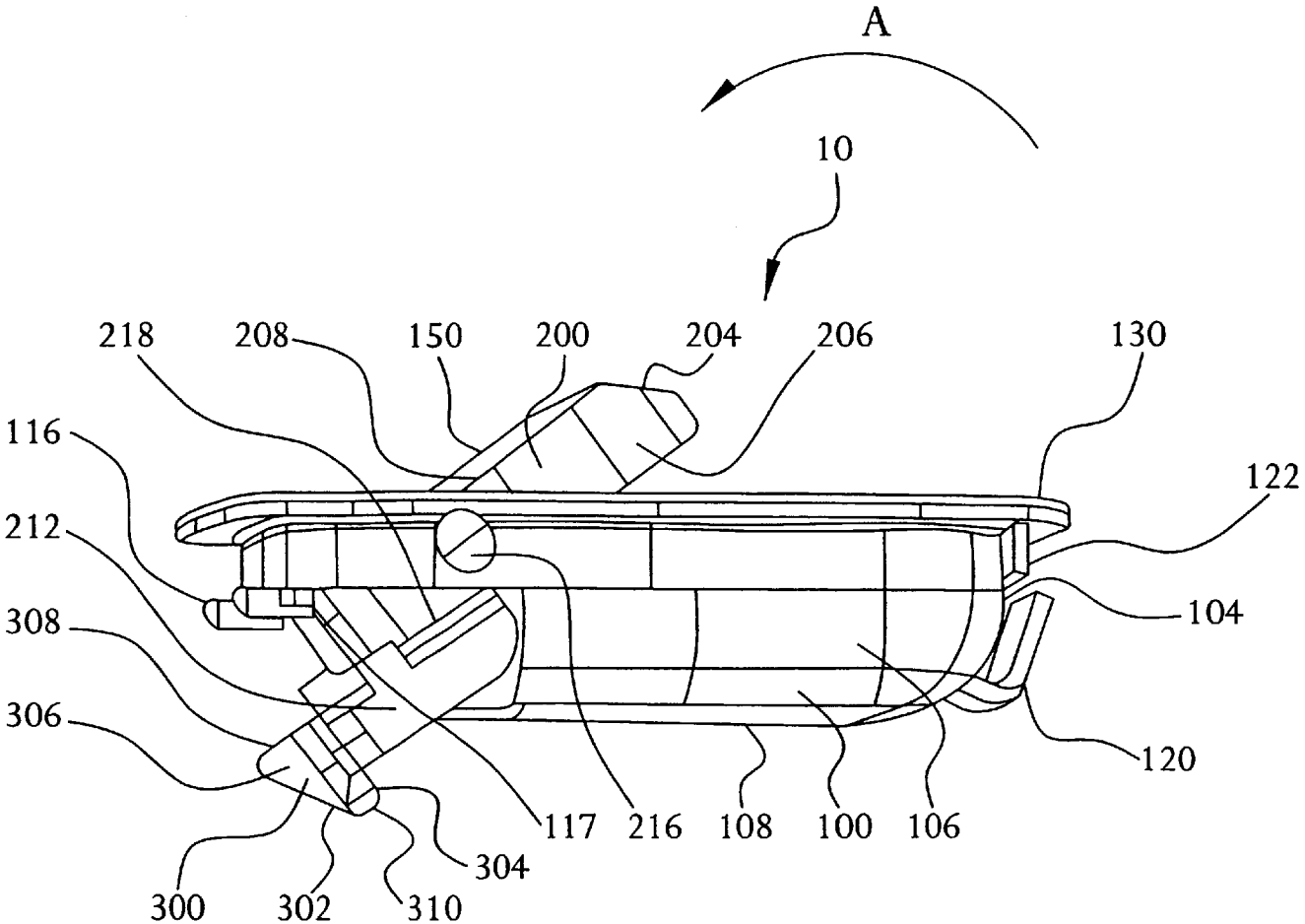
FIG. 8 is an left side view of the latch of FIG. 1, in the unlatched/open position.

The housing 100 includes a front wall 102, a rear wall 104 generally parallel to the front wall 102, a pair of generally parallel side walls 106, and a bottom wall 108. The walls 102, 104, 106, 108 and bottom 108 together comprise a generally rectangular well 109 having a substantially open top 110 and a substantially hollow interior 114 (FIG. 1). As best seen in FIG. 2, the housing 100 also includes a substantially vertical channel 112, a pair of lugs 116, a pair of guides 117, a pair of stops 118, and a resilient snap leg 120. As best seen in FIGS. 6–8, the housing further includes a vertical extension 122.

As can be seen in FIG. 2, the front wall 102, the side walls 106, and bottom wall 108 are cut away at one end of the housing 100, and they collectively define a cutout 124 that is dimensioned and configured to receive at least a pawl 300 when the housing 100 and handle unit 150 are secured to one another. Each side wall 106 of the housing 100 is substantially identical to one another and slopes downwardly and inwardly from about the midpoint of the side wall 106 to the bottom wall 108 of the housing 100. Each side wall 106 of the housing 100 includes means for pivotally securing the handle unit 150, preferably an aperture 126. It is preferred that the apertures 126 are opposite and substantially identical to one another and are located proximate the front and top of the side walls 106 of the housing 100. The bottom wall 108 of the housing 100 includes an upwardly extending flange 128 along its front edge. The top 110 of the housing 100 includes an outwardly extending flange 130 around its outer edge.

Figure 4:
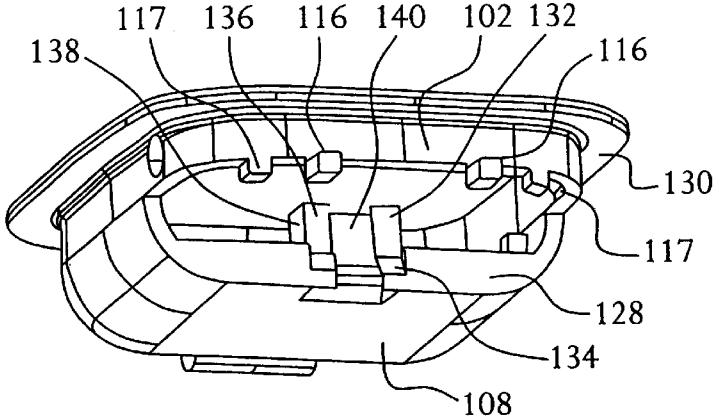
FIG. 4 is a bottom perspective view of a housing of the latch of FIG. 1.

The channel 112 (best illustrated in FIGS. 2,4, and 6) is positioned against and forward of the upwardly extending flange 128, and is dimensioned and configured to receive a flexible, channel-related spring or biasing member (described fully below). The channel 112 is also dimensioned and configured to retain the channel-related spring when the handle unit 150 is secured and actuating or pivoting relative to the housing 100. The channel 112 has an upperportion 132, a lower portion 134, a partial front wall 136, a pair of substantially identical side walls 138, and a rear wall 140. The lower portion 134 of the channel 112 is a predetermined amount wider from front to rear than the upper portion 132 of the channel 112. It is preferred that the channel 112 is located about the midpoint of the upwardly extending flange 128. The lugs 116 extend forwardly from the bottom edge of the front wall 102 of the housing 100 and help the latch 10 to engage with the lid (described below). The guides 117 extend downwardly from the bottom edge of the front wall 102 of the housing 110 and retrain horizontal movement of the pawl during slam action closing of the latch. The snap leg 120 extends initially downwardly and then upwardly from the rear wall 104 of the housing 100 so as to form a hook-like structure for also helping the latch 10 to engage with the lid. The stops 118 prevent the rear wall (described fully below) of the handle unit 150 from being pushed past a predetermined point when the rear wall of the handle unit 150 is pushed downward toward the housing 100. At the rear wall 104 of the housing 100, the vertical extension 122 extends downwardly from the outwardly extending flange 130 and also helps the latch 10 to engage with the lid.

The handle unit 150 is best illustrated in FIGS. 1, 2, 6, 6A and 8. The handle unit 150 includes a flush-fitting handle 200, a pawl 300, a pair of flexible, pawl-related springs or biasing members 212, and the flexible, channel-related spring or biasing member 214.

The handle 200 has a front wall 202, a rear wall 204, a pair of side walls 206, a top wall 208, and a substantially open bottom 210. The rear wall 204 of the handle 200 slopes downwardly and rearwardly, and permits the handle 20 to be lifted and rotated for opening and closing the latch 10. Each side wall 206 of the handle 200 is substantially identical to one another and includes means for pivotally securing the handle unit 150, preferably a pin 216 that is dimensioned and configured to fit within the corresponding aperture 126. It is preferred that the pins 216 are opposite and substantially identical to one another and are located proximate the front of the side walls 206 of the handle 200. The pins 216 may be chamfered to facilitate inserting the handle unit 150 into the housing 100. The location of the pins 216 and apertures 126 could of course be reversed.

The pawl 300 is positioned forward of and below the front wall 202 of the handle 200. The pawl 300 includes a front 302, a rear 304, a pair of sides 306, a top 308, and a bottom edge 310. The front 302 of the pawl 300 slopes rearwardly toward the bottom edge 310. The sides 306 of the pawl 300 are substantially identical to one another. The top 308 of the pawl 300 is substantially horizontal. The pawl 300 is attached to the pawl-related springs 212. The front 302 of the pawl 300 is provided with a plurality of channels 307 for strength.

Figure 5:
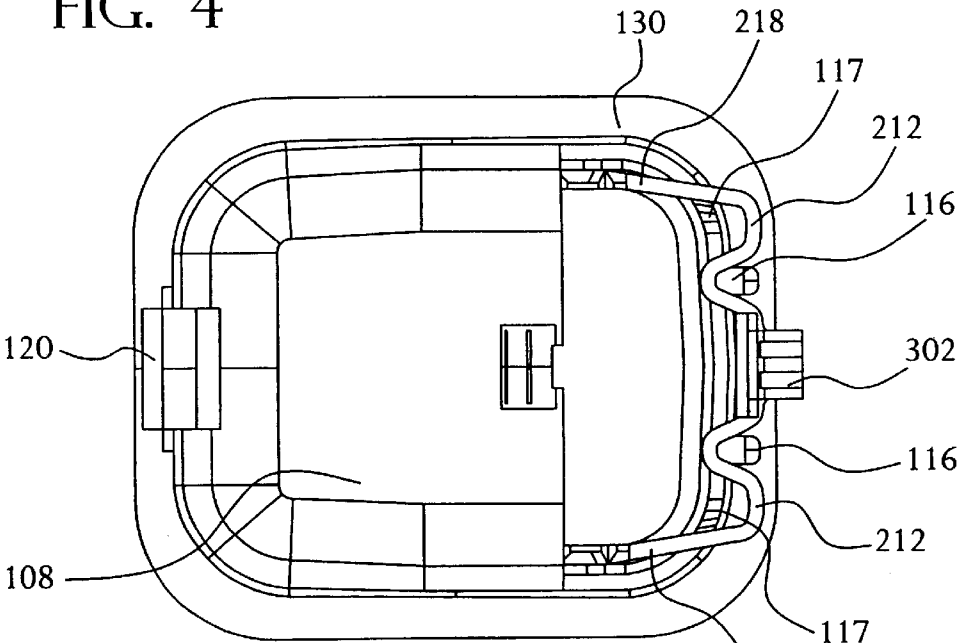
FIG. 5 is a bottom view of a housing of the latch of FIG. 1.

Each pawl-related spring 212 (best illustrated in FIGS. 1,2 and 5) has a first end 218, a second end 220, and a vertical extension 222, and can flex or bend upward and downward. Each first end 218 of the pawl-related spring 212 is attached to the bottom of a corresponding side wall 206 of the handle 200 at about the location of the corresponding pin 216. Each second end 220 of the pawl-related spring 212 is attached to a corresponding side 306 of the pawl 300. Each vertical extension 222 is positioned about a corresponding corner of the front wall 202 and side wall 206 of the handle 200, and helps prevent the pawl 300 and pawl-related springs 212 from flexing or bending upward past a predetermined point above their resting positions. The channel-related spring 214 (best illustrated in FIGS. 2 and 6) has a first end 224, a stem 226, and a generally "U"-shaped second end 228, and is substantially vertical in its relaxed position. The first end 224 of the channel-related spring 214 is attached to the bottom of the top 208 of the handle 200 preferably toward the rear wall 204. The generally "U"-shaped second end 228 is a predetermined amount wider from front to rear and from side to side than the stem 226, and is positioned within the lower portion 134 of the channel 112 when the handle unit 150 is secured to the housing 100. The shape and configuration of the generally "U"-shaped second end 228 help to retain the generally "U"-shaped second end 228 within the lower portion 134 of the channel 112 when the handle unit 150 is actuated or rotated relative to the housing 100.

The latch 10 is illustrated installed in the lid 402 within a load floor 400 in FIG. 7. The front 102 of the housing 100 is first inserted into an opening 404 in the lid 402 so that the edge of the opening 404 fits between the lugs 124 and the outwardly extending flange 130 of the top 110 of the housing 100. The latch 10 is then actuated or rotated downward so that the lid 402 strikes and displaces the snap leg 120, until the entire outwardly extending flange 130 of the top 110 of the housing 100 rests against the lid 402. Once the entire outwardly extending flange 130 rests against the surface of the lid 402, the snap leg 120 will resume its normal shape and at least its tip will be positioned beneath the underside of the lid 402. The latch 10 is thereby secured at the front end between the lugs 116 and outwardly extending flange 130, and at the rear end between the snap leg 120 and outwardly extending flange 130. If desired, a step may be cut around the opening 404 such that the outwardly extending flange 130 is completely flush with the surface of the lid 402.

The operation of the latch 10 is illustrated in FIGS. 6, 6A, 7 and 8. In the latched or closed position, the handle 200 is horizontal, and the pawl 300 is in its forward most position projecting beyond the edge of the outwardly extending flange 130. In this position, the top 308 of the pawl 300 is positioned beneath the underside 406 of the floor 400, preventing the lid 402 from being raised. The handle 200 is flush with the top of the housing 100. The handle 200 is retained in this position by the channel-related spring 214. The channel-related spring 214 and the channel 112 provide resistance to the actuation or rotation of the handle unit 150 to the unlatched or open position illustrated in FIG. 6 and 8, and bias the handle 200 such that the handle unit 150 remains in the latched or closed position in the absence of any force being applied by the user.

To open the lid 402, the user places his or her fingers in the finger cavity (not shown) defined by the housing 100 such that the user's fingers extend underneath the handle 200. The user can then lift the handle 200 upward by applying finger pressure, thus causing the handle unit 150, including the pawl 300 and the handle 200, to pivot about the pins 216 in the direction of arrow A (as illustrated in FIG. 8). As the handle unit 150 actuates or rotates in the direction of arrow A, the channel-related spring 214 bends or flexes within and outside of the upper portion 132 of the channel 112 in the direction of arrow A. The top 308 of the pawl 300 thereby disengages from the floor 400. The bending or flexing of the channel-related spring 214 permits continued upward rotation of the handle 200 until the pawl 300 is rotated clear of the floor 400 and the handle 200 is positioned in an optimum lifting position. The handle 200, which is now in the unlatched or open position illustrated in FIG. 8, may then be pulled upward to raise the lid 402.

The lid 402 may be latched closed by placing the handle 200 in the open position as the lid 402 is moved downward and placed into a closed position relative to the floor 400. When the handle 200 is released, the channel-related spring 214 will bend or flex back toward its original resting position within the channel 112 and move the pawl 300 to move back towards its latched position beneath the underside of the floor 400, thereby securing the lid 402 to the floor 400. Alternatively, the lid 402 may be latched closed by releasing the handle 200, and hence the lid 402 also. The release of the handle 200 permits the handle 200 to revert to its closed position and the pawl 300 to revert to its most extended forward position, as the lid 402 is moving downward toward the floor 400. When the pawl 300 that is in its most extended position initially makes contact with the floor 400, the pawl-related springs 212 bend or flex downwardly past the point of contact with the underside of the floor 400. However, in a short period of time, the pawl-related springs 212 will bend or flex upwardly back towards its resting position and permit the pawl 300 to make contact and engage with the underside of the floor 400, thereby securing the lid 402 to the floor 400.

It is preferred that the latch 10 be constructed of two separate pieces 100,150 as shown. However, the latch 10 may obviously be constructed of multiple pieces. It is also preferred that the handle unit 150 be constructed of metal, but the handle unit 150 could also be constructed of a suitable, sufficiently strong and rigid plastic material, or other suitable material. The housing 100 is preferably integrally formed from a suitable plastic material sufficiently strong, flexible and resilient so that the spring 214 provides an effective and suitable biasing force.

It is to be understood that the invention is not limited to the preferred embodiment described herein, but encompasses all embodiments within the scope of the following claims.

I claim:

1. A flush-mounted trunk-boot latch having an open position and a closed position, the trunk-boot latch comprising:

a housing including a front wall, bottom wall, a substantially hollow interior, and a channel vertically extending upward from the bottom wall;

a handle unit rotatably mounted in the interior of the housing, the handle unit including a handle, a downwardly extending spring member, and a pawl, the spring member being received within the channel;

wherein the channel is configured to retain the downwardly extending spring member when the handle unit undergoes rotational movement, and the housing comprises substantially parallel sidewalls each having an aperture and a stop means.

2. A flush-mounted trunk-boot latch having an open position and a closed position, the trunk-boot latch comprising:

a housing including a front wall, bottom wall, a substantially hollow interior, and a channel vertically extending upward from the bottom wall;

a handle unit rotatably mounted in the interior of the housing, the handle unit including a handle, a downwardly extending spring member, and a pawl, said pawl being mounted to the handle with a pair of pawl-related spring elements, the spring member being received within the channel;

wherein the channel is configured to retain the downwardly extending spring member when the handle unit undergoes rotational movement.

3. A trunk-boot latch according to claim 2, wherein the handle comprises pivot pins and the housing is provided with apertures, said pivot pins being configured to fit within said apertures thereby permitting rotational movement of the handle.

4. A trunk-boot latch according to claim 2, wherein the rotational movement of the handle is limited by a stop means provided on the housing.

5. A flush-mounted trunk-boot latch having an open position and a closed position, the trunk-boot latch comprising:

a housing including a front wall, bottom wall, a substantially hollow interior, and a channel vertically extending upward from the bottom wall;

a handle unit rotatably mounted in the interior of the housing, the handle unit including a handle, a downwardly extending spring member, and a pawl, the spring member being received within the channel;

wherein the channel is configured to retain the downwardly extending spring member when the handle unit undergoes rotational movement and the channel is attached to the bottom wall and the channel has a wide section and a narrow section.

6. A trunk-boot latch according to claim 5, wherein the downwardly extending spring member has a first end and a second end, wherein the second end is generally U-shaped.

7. A trunk-boot latch according to claim 6, wherein said second end is maintained within the channel.

* * * * *